US007779869B2

(12) United States Patent
Mettler

(10) Patent No.: US 7,779,869 B2
(45) Date of Patent: Aug. 24, 2010

(54) PROFILE ROD AND CARRIER ROD FOR A HEALD SHAFT

(75) Inventor: Franz Mettler, Wollerau (CH)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 12/232,130

(22) Filed: Sep. 11, 2008

(65) Prior Publication Data

US 2009/0065088 A1 Mar. 12, 2009

(30) Foreign Application Priority Data

Sep. 12, 2007 (EP) ..... 07017874

(51) Int. Cl.
*D03C 9/04* (2006.01)
*D03C 9/06* (2006.01)
*D03C 13/00* (2006.01)

(52) U.S. Cl. ..... 139/55.1; 139/91; 139/92

(58) Field of Classification Search ..... 139/55.1, 139/91–96
See application file for complete search history.

(56) References Cited

U.S. PATENT DOCUMENTS

| | | | | |
|---|---|---|---|---|
| 3,335,759 | A * | 8/1967 | Koch | 139/91 |
| 4,741,367 | A * | 5/1988 | Kitawaki | 139/91 |
| 4,753,273 | A * | 6/1988 | Gaisser | 139/91 |
| 5,005,607 | A * | 4/1991 | Shimizu | 139/91 |
| 5,232,025 | A | 8/1993 | Gysin et al. | |
| 5,297,589 | A * | 3/1994 | Baumann | 139/91 |
| 5,483,996 | A * | 1/1996 | Mettler | 139/91 |
| 5,887,629 | A * | 3/1999 | Mettler et al. | 139/91 |
| 6,732,767 | B2 * | 5/2004 | Baumann | 139/92 |
| 7,137,415 | B2 * | 11/2006 | Olbing et al. | 139/82 |
| 7,158,536 | B2 * | 1/2007 | Ching et al. | 370/468 |
| 7,264,022 | B2 * | 9/2007 | Mettler | 139/92 |
| 2004/0244862 | A1 * | 12/2004 | Gesing | 139/93 |
| 2005/0081942 | A1 * | 4/2005 | Schwane et al. | 139/92 |
| 2006/0090809 | A1 | 5/2006 | Fumex | |
| 2007/0062596 | A1 * | 3/2007 | Mettler | 139/82 |

FOREIGN PATENT DOCUMENTS

| | | |
|---|---|---|
| DE | 1 893 900 | 5/1964 |
| DE | 32 20 710 | 12/1983 |
| DE | 196 12 404 | 10/1997 |
| DE | 101 16 813 | 10/2002 |
| DE | 103 49 383 | 6/2005 |
| EP | 0 504 102 | 9/1992 |

* cited by examiner

*Primary Examiner*—Bobby H Muromoto, Jr.
(74) *Attorney, Agent, or Firm*—Fitch, Even, Tabin & Flannery; Norman N. Kunitz

(57) ABSTRACT

A profile rod (15) preferably consisting of an extruded aluminum profile has lateral walls (18, 19) that have two snap-in zones (25, 26) that project toward each other and extend parallel to each other over the entire length of the profile rod (15) and that are located on the same height. The distances of the two snap-in zones (25, 26) from the closest strip (21) correspond to each other. In this manner, the profile rod (15) may be made extremely thin-walled, on the one hand, and offers possibilities for fastening profile pieces that permit the input of larger forces into the profile rod (15) as well as the output of such forces therefrom, on the other hand. This concept offers a basis for the construction of light-weight heald shafts that can still handle great loads.

15 Claims, 6 Drawing Sheets

PROFILE ROD AND CARRIER ROD FOR A HEALD SHAFT

CROSS-REFERENCE TO RELATED APPLICATION

The present application claims the priority of European Patent Application No. 07 017 874.4, filed Sep. 12, 2007, the subject matter of which, in its entirety, is incorporated herein by reference.

BACKGROUND OF THE INVENTION

The invention relates to a profile rod, as well as to a carrier rod constructed with such a profile rod, for a heald shaft.

In most cases, heald shafts comprise two shaft rods, each consisting of a carrier rod and a heald mounting rail. The heald mounting rails act as a seat for the accommodation of a plurality of healds whose end eyelets are seated on the heald mounting rail. The carrier rod consists of a profile rod, for example in the form of an extruded aluminum profile, and additional elements such as, for example, steel inserts, for the connection of lateral supports.

Regarding this, document DE 196 12 404 A1, discloses, in particular, the corner connection of a heald shaft. The support shaft consists of an extruded aluminum profile that encloses a longitudinal hollow space. At the end of the carrier rod, the insert of steel is fastened in said rod's hollow space. This insert is connected to the aluminum carrier rod by means of a rivet.

Furthermore, document DE 101 16 813 A1 shows a possibility of riveting two inlays into the hollow space of a carrier rod and to clamp the projection of a lateral support between the inlays.

Furthermore, the use of an inlay that has threaded holes and is riveted in has been known from utility model DE 1 893 900 U.

Other parts that are to be fastened to a carrier rod are central connectors, for example. In conjunction with this, document DE 32 20 710 A1 discloses the insertion of a threaded plate in an appropriate chamber of the carrier rod that must have a profile specifically set up therefor.

In order to be able to fasten the above-described parts such as, for example, steel inserts or other anchoring elements to the carrier rod, its lateral walls or also other sections thereof must be dimensioned so as to display the appropriate strength. For example, a strip thickness or wall thickness is required that is substantially greater than would be necessary for the acceptance of miscellaneous forces and tensions based on cutting force analysis. This contributes considerably to the weight of the heald shafts, thus ultimately limiting the operating speed of said heald shafts. Consequently, considering modern high-speed weaving machines, such solutions have reached their performance limit. In order to improve this situation, document DE 103 49 383 A1 also suggested to glue a mounting plate into the hollow space of the aluminum profile. This solution is basically acceptable, however, because of the adhesive joint, this makes great demands on manufacture and is thus correspondingly expensive.

Therefore, it is the object of the present invention to provide a more cost-effective possibility of fastening accessory parts in a carrier rod, whereby the possibility of fastening is to be safe and simple and, nevertheless, permit the use of thin-walled profiles.

SUMMARY OF THE INVENTION

The above object is generally achieved in accordance with the invention in that a relatively thin-walled profile rod has snap-in zones on its lateral walls, whereby said zones can be used for fastening appropriately formed profile pieces, in particular by means of a riveting technique.

In so doing, it is possible, on the one hand, to design the lateral walls of the profile rod with a low wall thickness, whereas, on the other hand, the snap-in zones provide anchoring sites for the profile pieces that are to be attached. In the snap-in zones, portions of the lateral walls project into the hollow space enclosed by said walls. On the outside, the profile rod may be flat, i.e., be made without recesses. The snap-in zones then form zones that increase the wall thickness, where, for example, countersunk head rivets or countersunk head screws may be applied. Preferably, these do not project beyond the outside surface of the lateral wall.

The snap-in zone may also have a strip-shaped recess on the outside of the profile rod. Preferably, this recess is deep enough so that the flat head rivet or the round head rivet to be used for fastening profile pieces between the lateral walls has enough room. The recess may form a bead and preferably have a flat bottom. Referring to this embodiment, the wall thickness inside the recess is preferably at least as high as the wall thickness outside the snap-in zone.

Preferably, the snap-in zone takes up only a small portion of the height of the lateral wall. In so doing, the height should be measured in a direction parallel to the lateral wall in one direction and, in so doing, transversely to the profile rod. In assembled state of the heald shaft, this height direction is vertical. Preferably, the width of the snap-in zone takes up at least 5 percent, and at most 25 percent, of the width of the lateral wall.

Preferably, the profile rod is an extruded profile of light metal, for example, aluminum or an aluminum alloy. To accomplish this, said rod may be made in one piece and continuously, and is cut to appropriate lengths if needed. In this case, said rod consists of a uniform material and is formed in one piece.

Alternatively, the profile rod may be obtained by assembling several parts, for example, sheet metal parts, strips, rods and the like. These parts may consist of steel, light metal, plastic material, fiber-reinforced plastic material and the like, and may, for example, be welded together, glued together or assembled and connected to each other in another manner.

The concept in accordance with the invention is suitable for the connection of profile pieces, for the connection of lateral supports, as well as for the attachment of profile pieces for the connection of central connectors, drive plates, draw hooks or other parts to a heald shaft.

Additional details of advantageous embodiments of the invention are obvious from the description. It is restricted to the presentation of essential aspects of the invention and miscellaneous situations. The drawings disclose additional details and are meant to supplement the description.

DETAILED DESCRIPTION OF THE INVENTION

Figure 1:
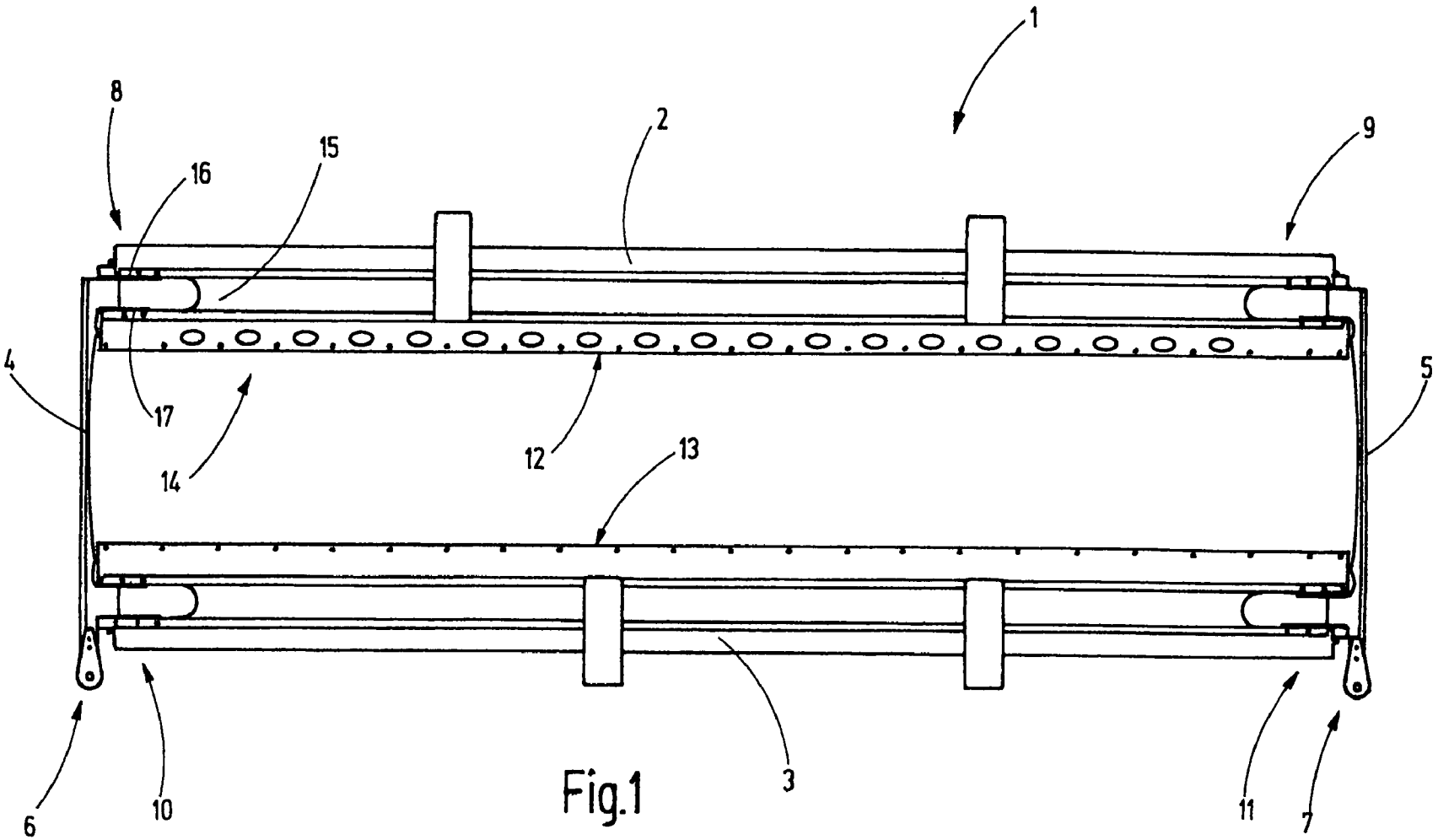
FIG. 1 is a simplified front view of a heald shaft.

FIG. 1 shows a heald shaft 1 which comprises an upper shaft rod 2, a lower shaft rod 3 and lateral supports 4, 5 that, together, form a rectangular frame. The lateral supports 4, 5 have connectors 6, 7 that are to be connected to a drive device of the weaving machine. In addition, they are provided with extensions that are inserted and fixed in place in correspondingly reinforced ends 8, 9, 10, 11 of the shaft rods 2, 3. In addition, the shaft rods 2, 3 have heald mounting rails 12, 13 that are disposed to accommodate the healds.

Figure 2:
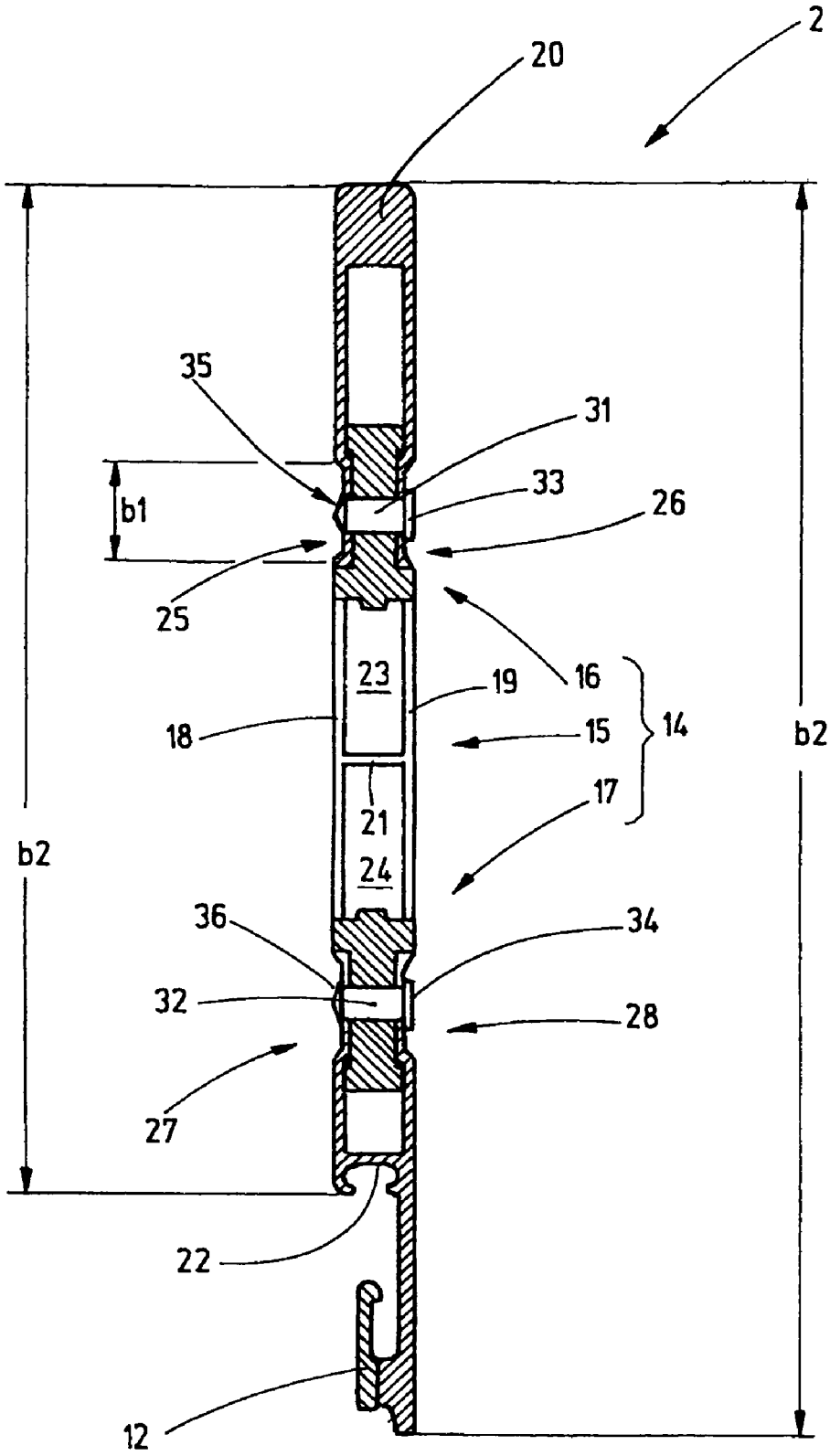
FIG. 2 is a view, vertically in section, of a shaft rod in accordance with FIG. 1.

FIG. 2 shows the shaft rod 2; in principle, its construction is identical to that of the shaft rod 3. The shaft rod 2 comprises a carrier rod 14 and a heald mounting rail 12. The latter is, for example, a profiled steel rail that is detachably or permanently connected to the carrier rod 14, for example by riveting, cementing, welding, clamping or the like.

The carrier rod 14 is made of a profile rod 15 and of profile pieces 16, 17 that are provided on the profile rod 15. The profile rod 15 is preferably an extruded aluminum profile. It has two preferably spaced-apart, parallel oriented lateral walls 18, 19 that extend along the profile rod 15 in longitudinal direction of the rod (perpendicular to the plane of projection in FIG. 2) and thus parallel to the heald mounting rail 12, and that are oriented in horizontal direction during use. In FIG. 2, the height of the lateral walls 18 and 19 is b2 and may have different sizes. The lateral walls 18, 19 are connected to each other by strips 20, 21, 22 and enclose at least one or also more hollow spaces 23, 24. The lateral walls 18. 19 are—in particular on the outside—essentially flat (preferably planar). For fastening the profile pieces 16, 17, at least one of the lateral walls 18, 19 has, at least at one point, a snap-in zone 25, 26, 27, 28. These snap-in zones 25 through 28 are preferably strip-shaped areas that extent over the entire length of the profile rod 15. In FIG. 2, the height of the snap-in zones 25 through 28 is b1 and can amount to 5% to 25% of the height b2 of the lateral wall 18, 19. In addition, these snap-in zones 25 through 28 are preferably not in direct contact with the strips 20, 21, 22 but are arranged at a distance therefrom.

Figure 3:
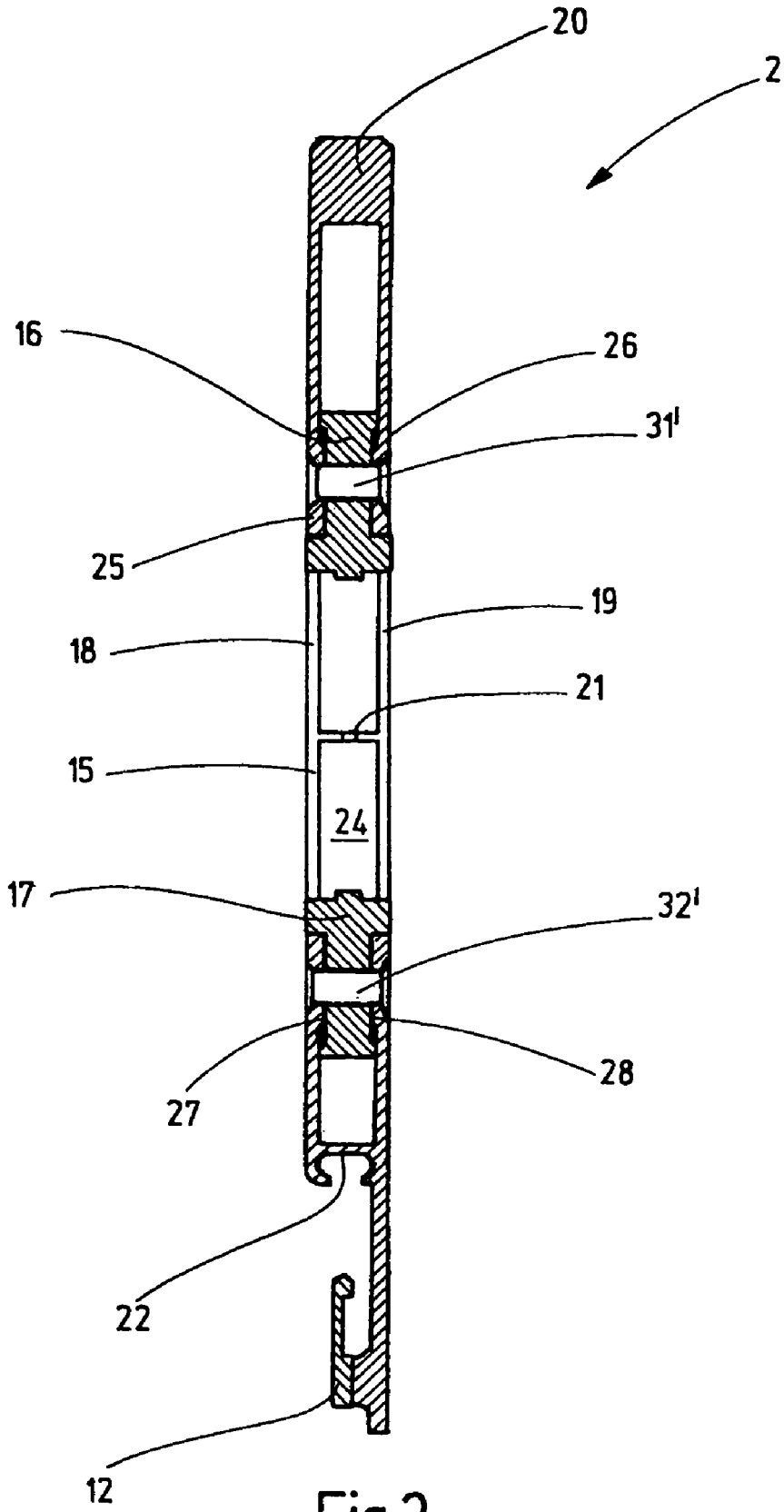
FIG. 3 is a view, vertically in section, of a modified embodiment of a shaft rod.

The snap-in zones 25 through 28 are characterized in that the lateral wall 18, 19 projects into the respective hollow space 23 or 24. This can be achieved, as indicated in FIG. 2, in that the lateral walls 18, 19 have sections that are slightly offset toward an imaginary vertical center plane of the profile rod 15. Alternatively, as indicated in FIG. 3, this can be achieved in that the wall thickness of the lateral walls 18, 19 is increased in the snap-in zones 25 through 28.

Figure 4:
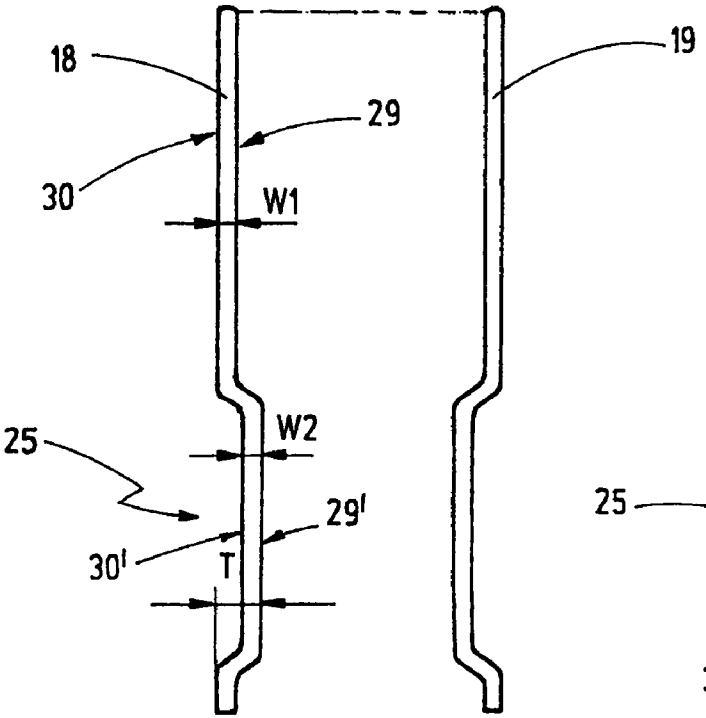

For further explanation, reference is first made to FIG. 4 that shows a detail of the cross-section of the profile rod 15 in accordance with FIG. 2. The lateral walls 18, 19 may be mirror-symmetrical. The description of the lateral wall 18 hereinafter thus applies analogously to the lateral wall 19.

The lateral wall 18 has an inside 29 and an outside 30. The inside 29, as well as the outside 30, may be planar, with the exception of the snap-in zone 25. The wall thickness W1 of the lateral wall 18 is to be measured between the inside 29 and the outside 30. The wall thickness W2 is to be measured in the snap-in zone 25 between the insides 29' and 30', respectively. Preferably, the wall thickness W2 corresponds to the wall thickness W1; optionally, it may also be greater or smaller.

In this exemplary embodiment, as is shown by FIG. 4, the snap-in zone 25 represents a flat recess, e.g., in the form of a groove, that is open toward the outside and has a bottom that is formed by the outside surface 30'. The distance of this bottom 30' from the plane defined by the outside surface 30, represents the depth T of the snap-in zone. Preferably, this depth T is greater than the wall thickness W1. In this configuration, the profile rod 15 may be configured as an extruded profile as well as be constructed of one or more sheet metal parts. In particular, the lateral walls 18, 19 may be sheet metal parts.

As is shown by FIG. 2, the profile piece 16, 17 has grooves on its two flat sides, said grooves being able to accommodate projections formed by the snap-in zones 25, 26, 27, 28. To this extent, the lateral surfaces of the profile pieces 16, 17 are configured complementary to the inside surfaces of the lateral walls 18, 19.

The profile pieces 16, 17 may have the same or a different configuration. However, they have at least one, preferably more, throughbores extending in transverse direction from one lateral wall to the other lateral wall, said throughbores being disposed to receive fastening means, e.g., in the form of rivets 31, 32. The fastening means 31, 32 are, for example, round head rivets or flat head rivets with heads 33, 34 having a height that is less than the depth T (in accordance with FIG. 4). This also applies analogously to the round heads 35, 36 on the other end of the respective rivet 31, 32. It is also possible to use other fastening means such as, e.g., screws.

As indicated in FIG. 1, the profile pieces 16, 17 may be provided on the legs of the profile rod 15 and receive between them a projection of the lateral support 4. In so doing, a robust corner connection is created which also permits the input of great forces into the carrier rods 14 that have very thin lateral walls with a wall thickness W1 of, e.g., less than one millimeter.

Figure 5:
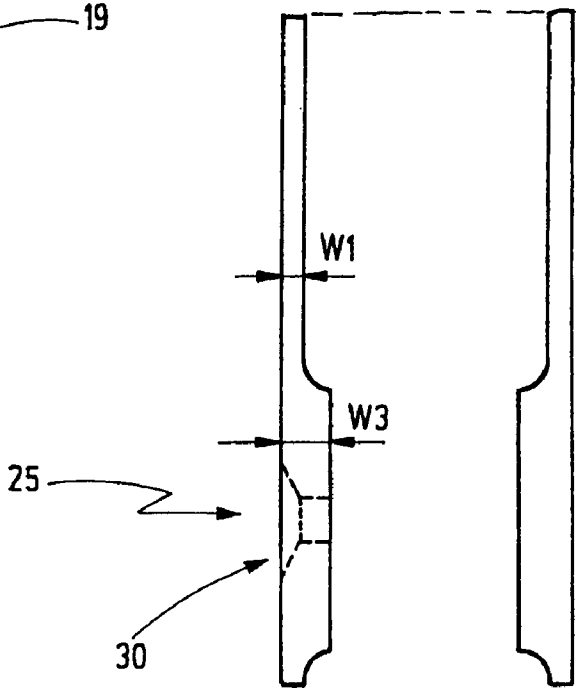

As already indicated in conjunction with FIG. 3, the snap-in zones 25 through 28 located at a distance from the strips 20, 21, 22 may also have a wall thickness W3 that is significantly greater than the wall thickness W1. This is shown in FIG. 5. In this case, the outside surface 30 may be flat overall, i.e., not have any recesses specifically in the area of the snap-in zone 25. The increased wall thickness W3 permits the application of flat head rivets as indicated in dashed lines in FIG. 5. Such a flat head rivet 31', 32' (FIG. 3) is flush with the outside 30 or even forms a small recess.

Figure 6:
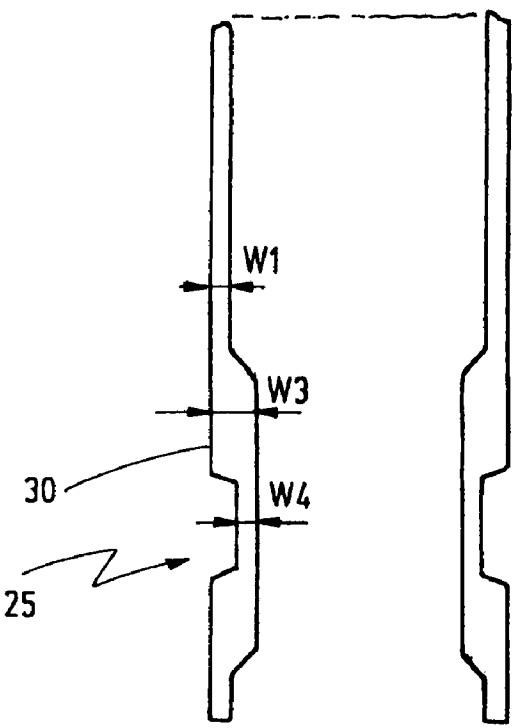
FIGS. 4 through 6 show different embodiments of profile rods for the construction of a shaft rod.

As shown by FIG. 6, it is also possible to provide a strip-shaped recess inside the snap-in zone 25, said recess having a wall thickness W4 that is smaller than the wall thickness W3. It may be greater or smaller than the wall thickness W1, or it may be the same. Again, similar to the exemplary embodiment in accordance with FIG. 4, a snap-in region is created in which flat head and round head rivets can be accommodated, whereby—parallel to the recess provided in the outside surface 30—there extends at least one reinforced area having a greater wall thickness W3, the latter providing additional stiffness.

Figure 7:
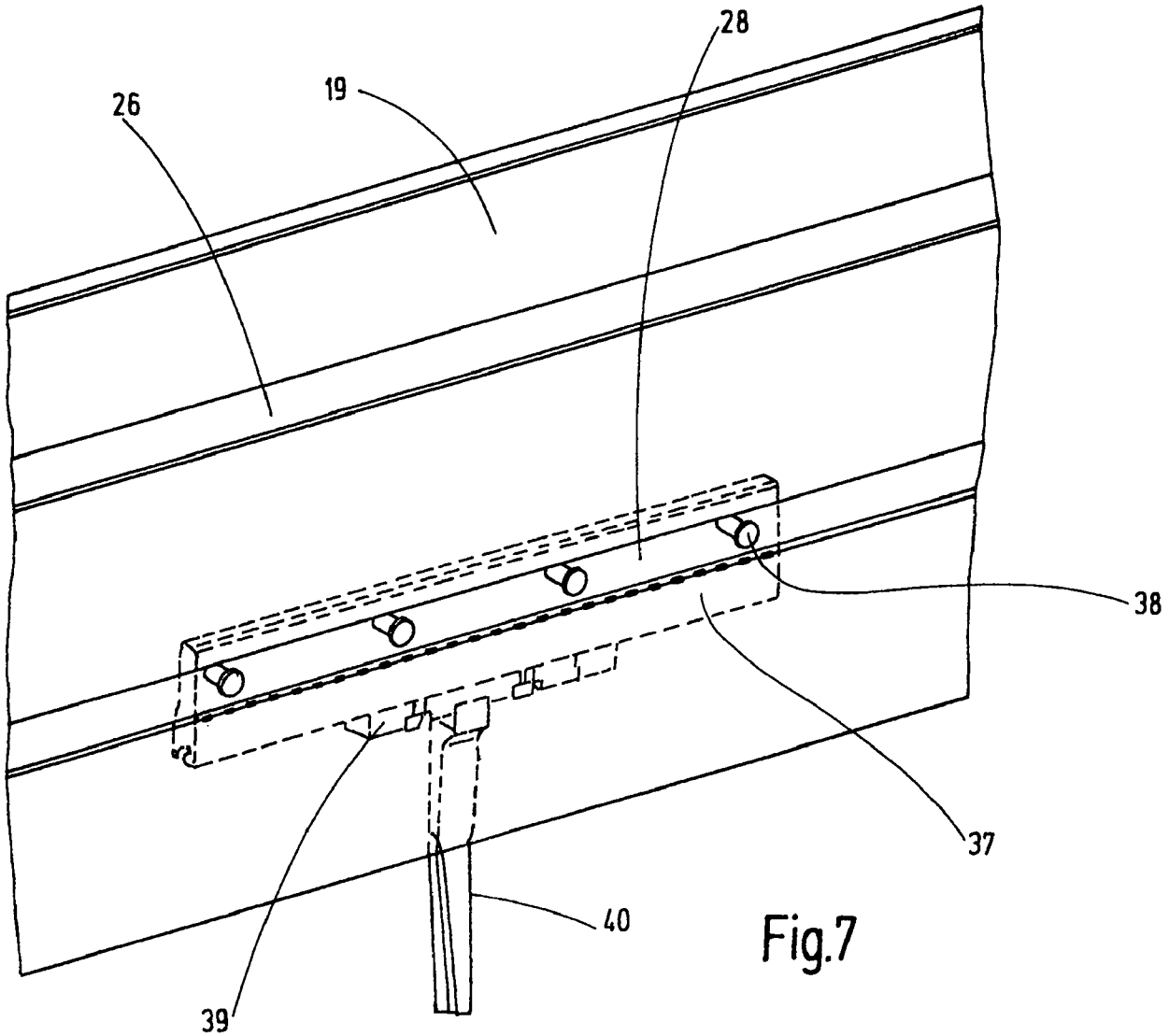
FIG. 7 is a perspective view, viewed from one side, of a shaft rod with connected central connector.
Figure 8:
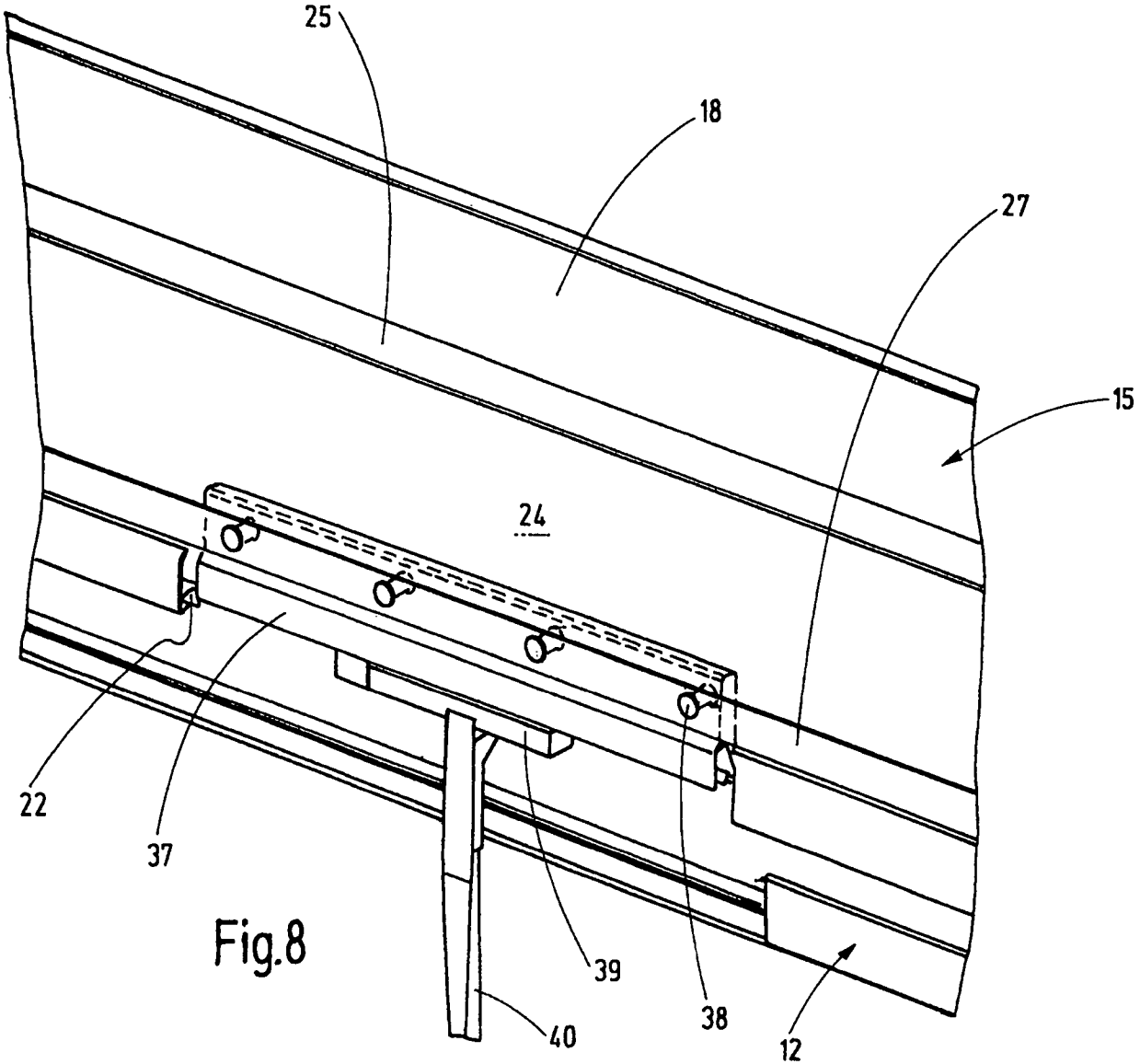
FIG. 8 is a perspective view of the shaft rod in accordance with FIG. 7, viewed from the opposite side of said shaft rod.

The introduced configuration of the profile rod 15 offers not only the possibility of connecting the profile pieces 16, 17 to the ends of the shaft rod 2, 3; but, in addition—as shown by FIGS. 7, 8—the possibility of attaching additional elements. As is shown by FIG. 8, the strip 22 may be provided with a cutout, so that a profile piece 37 may be inserted from below between the snap-in zones 27, 28. The snap-in zones 27, 28, in turn, represent fastening regions, in which the profile piece 37 can be fastened by means of suitable fastening means such as screws or, in particular, rivets 38. A central connector 40 may be fastened to the profile piece 37, e.g., by using a threaded plate 39. To do so, the profile piece 37 may be provided with appropriate threaded pocket holes.

For example, the profile pieces 16, 17, 37 may consist of steel. The profile piece 37 may be provided, for example, with a T-groove for the accommodation of the threaded plate 39. Due to the large-area attachment of the profile piece 37 in the hollow space 24 of the profile rod 15 by means of several rivets 38, a fastening possibility for the cross-brace or the central connector 40 is proved, said possibility permitting considerably higher loads than the so-far known solutions.

Profile pieces that have been riveted or screwed together may also be used for fastening coupling elements that create the connection between the heald shaft and its drive devices. For example, draw hooks are mentioned here, these being connected to pull ropes or return springs of negative-acting shaft machines.

With the use of shaft machines, whose up-and-down acting drive movement of the shafts is subject to restraint (positive shaft machine), the shafts are connected—by loops—in the manner of the connections 6 and 7 (FIG. 1) to the bearer (shaft draw). Such connections cannot only be fastened to lateral supports, they are—in particular with long shafts—also connected in at least two locations to the lower shaft rod 3. These loops can also be provided on profile pieces that have been applied in accordance with the invention.

A profile rod 15 preferably consisting of an extruded aluminum profile has lateral walls 18, 19 that have two snap-in zones 25, 26 that project toward each other and extend parallel to each other over the entire length of the profile rod 15 and that are located on the same height. The distances of the two snap-in zones 25, 26 from the closest strip 21 correspond to each other. In this manner, the profile rod 15 may be made extremely thin-walled, on the one hand, and offers possibilities for fastening profile pieces that permit the input of larger forces into the profile rod 15 as well as the output of such forces therefrom, on the other hand. This concept offers a basis for the construction of light-weight heald shafts that can still handle great loads.

It will be appreciated that the above description of the present invention is susceptible to various modifications, changes and modifications, and the same are intended to be comprehended within the meaning and range of equivalents of the appended claims.

REFERENCE NUMBERS

1 Heald shaft
2, 3 Shaft rod (=carrier rod+heald mounting rail)
4, 5 Lateral support
6, 7 Connector
8-11 Ends
12, 13 Heald mounting rail
14 Carrier rod (=profile rod+profile pieces)
15 Profile rod
16, 17 Profile pieces
18, 19 Lateral walls
20, 21, 22 Strips
23, 24 Hollow spaces
25-28 Snap-in zone
29, 29' Inside surface
30, 30' Outside surface, bottom
31, 32 Rivet
31', 32' Rivet
33, 34 Flat heads
35, 36 Round heads
37 Profile piece
38 Rivet
39 Threaded plate
40 Central connector

I claim:

1. A profile rod for a shaft rod of a heald shaft, said profile rod being configured as a hollow profile with opposed lateral walls which delimit between them at least one hollow space, and wherein opposed the lateral walls have outside surfaces with respective strip-shaped snap-in zones located opposite one another, with inner surfaces of the lateral walls within the snap-in zones extending inwardly to provide a spacing between the inner surfaces in the snap-in zones that is smaller than the spacing between the opposed inner surfaces in the remainder of the hollow space.

2. A profile rod in accordance with claim 1, wherein the snap-in zone extends in a longitudinal direction of the profile rod.

3. A profile rod in accordance with claim 1, wherein the snap-in zone has a flat bottom.

4. A profile rod in accordance with claim 1, wherein the flat bottom is oriented parallel to the outside surface.

5. A profile rod in accordance with claim 1, wherein the snap-in zone a has a depth (T) which is greater than the wall thickness (w1) of the lateral wall measured in the same direction.

6. A profile rod in accordance with claim 1, wherein the wall thickness (w2) of the lateral wall inside the snap-in zone corresponds to the wall thickness (w1) of the lateral wall outside the snap-in zone.

7. A profile rod in accordance with claim 1, wherein the wall thickness (w3) of the lateral wall inside the snap-in zone is greater than the wall thickness (w1) of the lateral wall outside the snap-in zone.

8. A profile rod in accordance with claim 7, wherein at least one of the lateral walls has a recess formed in its outer surface in the snap-in zone.

9. A profile rod in accordance with claim 1, wherein the height (b1) of the snap-in zone amounts to at least 5% and at most 25% of the height (b2) of the lateral wall.

10. A profile rod in accordance with claim 1, wherein the hollow profile is a seamless, one-piece light-metal extrusion profile consisting of a uniform material.

11. A profile rod in accordance with claim 1, wherein the hollow profile consists of several parts of steel and/or fiber-reinforced plastic material, said parts being connected to each other in order to form a uniform component.

12. A carrier rod with a profile rod in accordance with claim 1, wherein a profile piece is held between the lateral walls, with said profile piece extending between the inner surfaces of the lateral walls within the snap-in zones.

13. A carrier rod in accordance with claim 12, wherein the profile piece is held by fastening means arranged in the snap-in zone.

14. A carrier rod in accordance with claim 13, wherein the fastening means has the form of a rivet.

15. A carrier rod in accordance with claim 12, wherein the profile piece has at least one threaded bore for fastening a cross-brace.

* * * * *